US007296520B1

(12) United States Patent
McMullen, Jr.

(10) Patent No.: US 7,296,520 B1
(45) Date of Patent: Nov. 20, 2007

(54) EXTERNAL TELEMETRY UNIT

(75) Inventor: Kenneth R. McMullen, Jr., Port Deposit, MD (US)

(73) Assignee: United States of America as Represented by the Secretary, Washington, DC (US)

( * ) Notice: Subject to any disclaimer, the term of this patent is extended or adjusted under 35 U.S.C. 154(b) by 225 days.

(21) Appl. No.: 10/988,106

(22) Filed: Nov. 15, 2004

(51) Int. Cl.
*H01Q 1/28* (2006.01)
*F42C 13/04* (2006.01)

(52) U.S. Cl. ..... 102/214; 102/384; 102/293; 343/708; 244/3.14; 89/1.1

(58) Field of Classification Search ..... 102/473, 102/498, 501, 517, 529, 293, 214, 384; 89/6, 89/6.5, 1.1, 1.11; 244/3.14; 343/705, 708
See application file for complete search history.

(56) References Cited

U.S. PATENT DOCUMENTS 2,920,567 A * 1/1960 Flett ..... 102/214
3,127,609 A * 3/1964 Wentworth ..... 343/708
3,293,645 A * 12/1966 Farley et al. ..... 343/708
3,475,755 A * 10/1969 Bassen et al. ..... 343/705
3,798,653 A * 3/1974 Jones, Jr. ..... 343/708
3,810,183 A * 5/1974 Krutsinger et al. ..... 343/708
3,914,767 A * 10/1975 Jones, Jr. ..... 343/708
4,816,836 A * 3/1989 Lalezari ..... 343/700 MS
6,020,854 A * 2/2000 Jagnow et al. ..... 343/705
6,098,547 A * 8/2000 West ..... 102/214
6,307,514 B1 * 10/2001 West ..... 343/705
6,349,652 B1 2/2002 Hepner et al.
6,919,846 B2 * 7/2005 Koch et al. ..... 343/705
7,057,567 B2 * 6/2006 Koch ..... 343/708

* cited by examiner

*Primary Examiner*—James S Bergin
(74) *Attorney, Agent, or Firm*—Alan P. Klein

(57) ABSTRACT

An external telemetry unit for a projectile. The external telemetry unit comprises a shell adapted to be inserted between the front of the projectile body and the fuze, a flexible battery and flexible electronic circuitry encircling the front of the shell, and a plurality of contoured antennas covering the flexible battery and flexible electronic circuitry. The inside of the shell is formed to match the contour of the projectile.

11 Claims, 3 Drawing Sheets

EXTERNAL TELEMETRY UNIT

BACKGROUND OF THE INVENTION

This invention relates in general to ammunition and explosives, and more particularly, to explosive-containing projectiles.

U.S. Pat. No. 6,349,652, issued to Hepner et al., describes an aeroballistic diagnostic system for obtaining information relative to the flight of a projectile launched from the bore of a gun. The projectile's functioning fuze mechanism is replaced with a fuze-shaped body containing a telemetry unit. The problem with using this diagnostic system is that it renders the projectile inoperable as originally designed.

SUMMARY OF THE INVENTION

It is therefore an object of this invention to provide diagnostic measurements of in-flight characteristics of a projectile, while still allowing the projectile to function as originally designed.

This and other objects of the invention are achieved in one aspect by an external telemetry unit for a projectile. The external telemetry unit comprises a shell adapted to be inserted between the front of the projectile body and the fuze, and means on the front of the shell for obtaining projectile data while the projectile is in flight and transmitting the data to a ground station for analysis.

Another aspect of the invention involves a method of assembling an external telemetry unit for a projectile. The method comprises the steps of providing a shell whose inside is formed to match the contour of the projectile body, encircling the front of the shell with a flexible battery and flexible electronic circuitry, and covering the flexible battery and flexible electronic circuitry and with a plurality of contoured antennas.

A further aspect of the invention involves a method of using an external telemetry unit comprising the steps of removing the fuze from a projectile, sliding the unit over the front of the projectile body, and reinstalling the fuze.

The invention has the advantage that in-flight diagnostic measurements relative to a projectile can be made with it without rendering the projectile inoperative. Furthermore, since the components of the invention are wrapped around the curved shape of the projectile in a flexible housing, this is done without changing the projectile's aerodynamic profile.

Additional advantages and features will become apparent as the subject invention becomes better understood by reference to the following detailed description when considered in conjunction with the accompanying drawings wherein:

DETAILED DESCRIPTION

Figure 1:
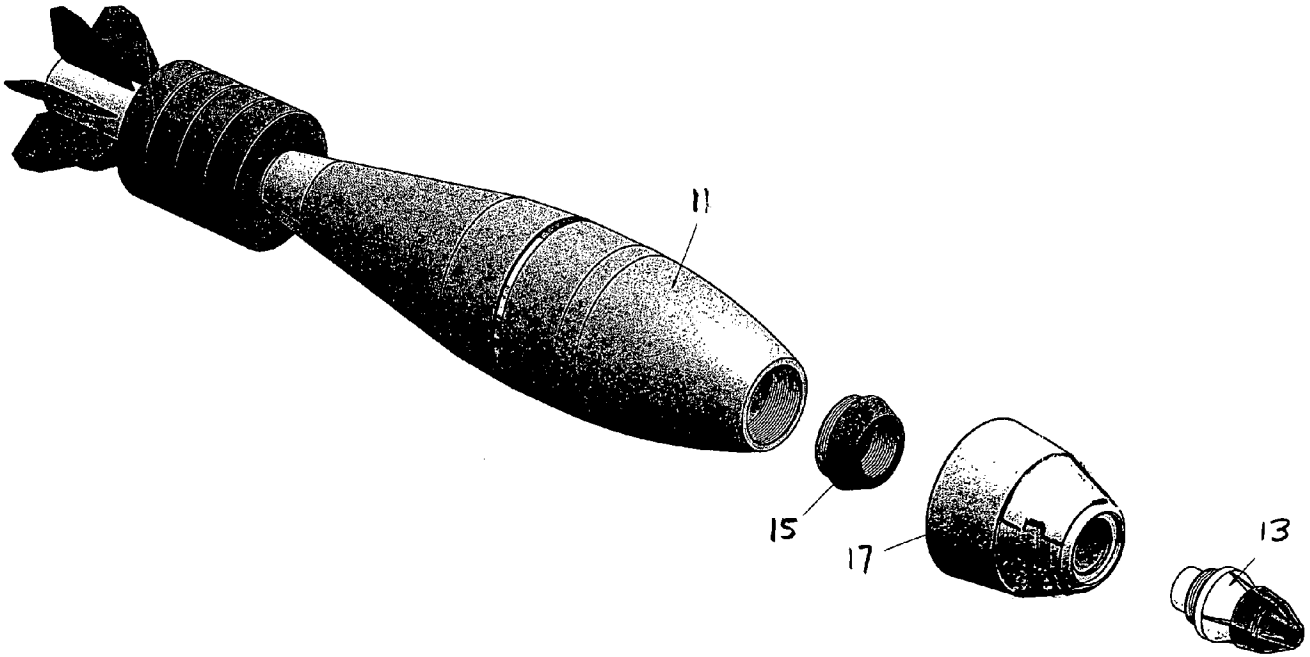
FIG. 1 is a schematic illustration of a projectile embodying the invention.

The invention as embodied in a typical projectile is illustrated in FIG. 1. The projectile includes a projectile body 11, filled with an explosive bursting charge, and a fuze 13, threaded onto the front end of the body by means of an adaptor 15, for causing detonation of the charge as a result of impact with, or proximity to, a target. The projectile is itself known in the art and its detailed operation is well understood in the art. Such a projectile is shown for example in U.S. Pat. No. 6,349,652, whose disclosure is hereby incorporated by reference. In that patent, the functioning fuse is removed and replaced by an inert fuse body containing an internal telemetry unit. According to the present invention, the functioning fuse is not removed, and an external telemetry unit 17 is added to the projectile.

Figure 2:
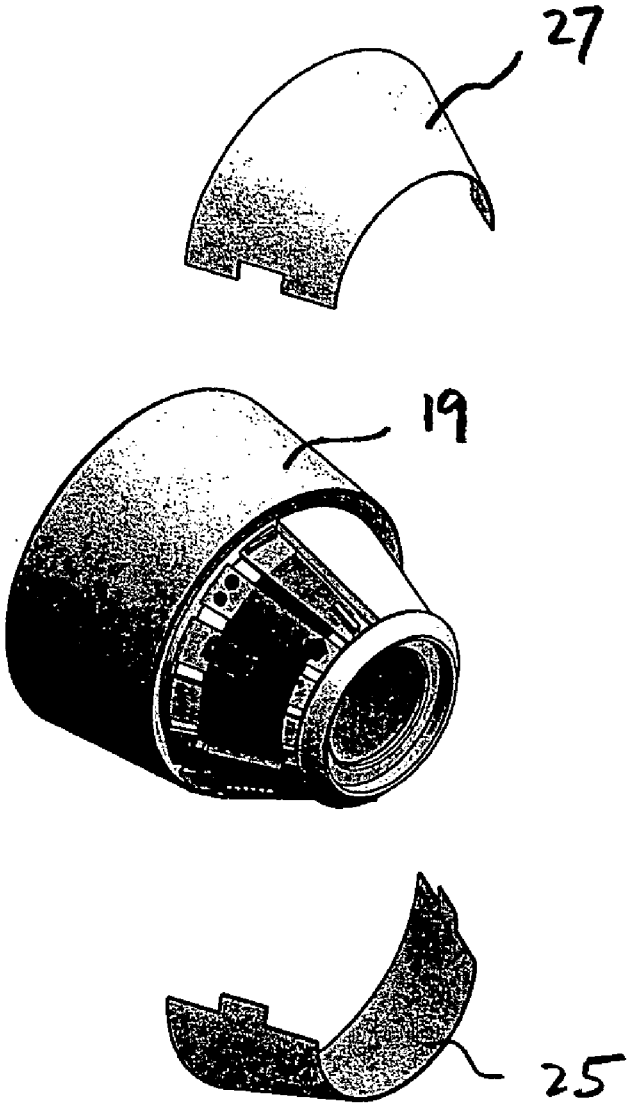
FIG. 2 is a partially exploded view of the external telemetry unit disconnected from the rest of the projectile of FIG. 1 showing the unit disassembled with the antennas removed.
Figure 3:
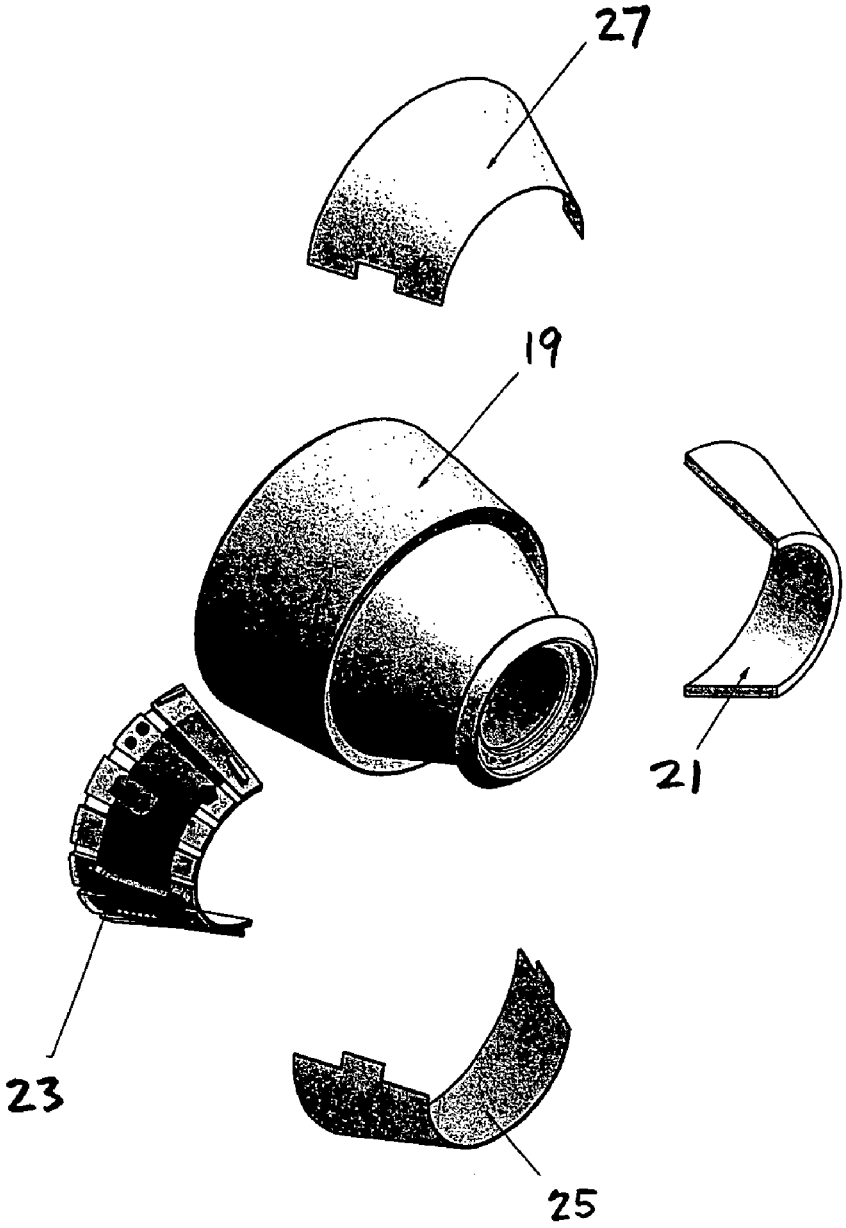
FIG. 3 is a full exploded view of the external telemetry unit disconnected from the rest of the projectile of FIG. 1 showing the unit disassembled to its major components.

Referring to FIGS. 2-3, wherein like reference numerals designate like or corresponding parts, the external telemetry unit 17 is shown disconnected from the rest of the projectile shown in FIG. 1. The external telemetry unit 17 includes a shell 19 adapted to be inserted between the front of the projectile body 11 and the fuze 13, and means on the front of the shell for obtaining projectile data while the projectile is in flight and transmitting the data to a ground station for analysis. The inside of the shell 19 is formed to match the contour of the projectile body 11 to be instrumented. While the data obtaining and transmitting means may take a variety of forms, conveniently it may take the form shown of a flexible battery 21, flexible electronic circuitry 23 composed of components such as described in the afore-mentioned U.S. Pat. No. 6,349,652, and a pair of antennas 25 and 27. The flexible battery 21 and flexible electronic circuitry 23 encircle the front of the shell 19. Suitable flexible batteries may be purchased from Volta Flex, Menlo Park, Calif., for example. The flexible electronic circuitry may be manufactured using well-known printed circuit techniques. The antennas 25 and 27, which may be L-band and S-band antennas, are wrapped around the flexible battery 21 and flexible electronic circuitry 23 and completely enclose them to protect them from the environment. The manufacture of the antennas 25 and 27 is within the capabilities of one skilled in the art. The antennas 25 and 27 are contoured like the projectile body 11 to keep the aerodynamic signature of the instrumented projectile body 11 as close as possible to the original.

In operation, the external telemetry unit 17 is powered up. Then, the fuze 13 of the projectile whose diagnostic measurements are to be provided is removed, and the user slides the external telemetry unit 17 over the front of the projectile body 11. Next, the fuze 13 is reinstalled, holding the external telemetry unit 17 in place. Finally, the projectile is fired. While the projectile is in flight, the external telemetry unit 17 transmits projectile data to a ground station for analysis. When the projectile reaches its target, it detonates, as it was originally designed to do.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. An external telemetry unit for a projectile having a projectile body and a fuze, the external telemetry unit comprising:

a shell adapted to be inserted between the front of the projectile body and the fuze; and means on the front of the shell for obtaining projectile data when the shell is attached to the projectile and the projectile is in flight and for transmitting the data to a ground station for analysis, wherein the data obtaining and transmitting means includes a battery.

2. The unit recited in claim 1 wherein the battery is made from a flexible material.

3. The unit recited in claim 2 wherein the data obtaining and transmitting means includes:

electronic circuitry.

4. The unit recited in claim 3 wherein the electronic circuitry is made from a flexible material.

5. The unit recited in claim 4 wherein the battery and the electronic circuitry encircle the front of the shell.

6. The unit recited in claim 5 wherein the data-obtaining-and-transmitting means includes:

a pair of antennas.

7. The unit recited in claim 6 wherein the antennas are contoured.

8. The unit recited in claim 7 wherein the contoured antennas cover the battery and the electronic circuitry.

9. The unit recited in claim 8 wherein the antennas are contoured like the projectile body to keep the aerodynamic signature as close as possible to the aerodynamic signature of the projectile and fuze alone.

10. The unit recited in claim 9 wherein one of the antennas is an L-band antenna.

11. An external telemetry unit for a projectile having a projectile body and a fuze, the external telemetry unit comprising:

a shell adapted to be inserted between the front of the projectile body and the fuze, the inside of the shell being formed to match the contour of the projectile body;

a battery made from a flexible material and electronic circuitry made from a flexible material encircling the front of the shell; and a pair of contoured antennas covering the battery and the electronic circuitry.

* * * * *